United States Patent [19]

Chachin et al.

[11] 4,313,334

[45] Feb. 2, 1982

[54] STRIKER STARTING MECHANISM OF HYDRODYNAMIC UNIT

[76] Inventors: Viktor N. Chachin, ulitsa Kulman, 15, kv. 91; Vladimir K. Kolos, ulitsa Kulman, 26, kv. 50; Viktor V. Botyan, ulitsa Lenina, 11/35, kv. 11; Vladimir I. Luzgin, ulitsa Plekhanova, 63, kv. 52; Vyacheslav A. Kashperko, prospekt Partizansky, 28, korpus 2, kv. 134, all of Minsk, U.S.S.R.

[21] Appl. No.: 95,390

[22] Filed: Nov. 19, 1979

[51] Int. Cl.[3] ..... B21J 7/28

[52] U.S. Cl. ..... 72/453.1

[58] Field of Search ..... 72/453.1, 453.01, 453.02, 72/453.11, 453.18, 60, 63

[56] References Cited

U.S. PATENT DOCUMENTS 3,205,790 9/1965 Bollar ..... 72/453.1
3,352,143 11/1967 Bollar ..... 72/453.11
3,376,723 4/1968 Chelminski ..... 72/453.1
3,584,498 6/1971 Beche ..... 72/453.18

FOREIGN PATENT DOCUMENTS 524595 10/1976 U.S.S.R. ..... 72/453.1

*Primary Examiner*—Gene P. Crosby
*Attorney, Agent, or Firm*—Lilling & Greenspan

[57] ABSTRACT

The herein disclosed mechanism comprises a compressed gas receiver, a shaft with a striker movable therein, and control and working cylinders arranged in series one after the other, whose pistons are interconnected by means of a rod. According to the present invention, said working cylinder is mounted in the receiver and defines a circular space between the end of the receiver and the end of the shaft. In so doing, said circular space communicates with the receiver space while the piston of said working cylinder is mounted for movement relative to the rod to permit pressure from the receiver to pass and drive the striker for a working stroke.

3 Claims, 1 Drawing Figure

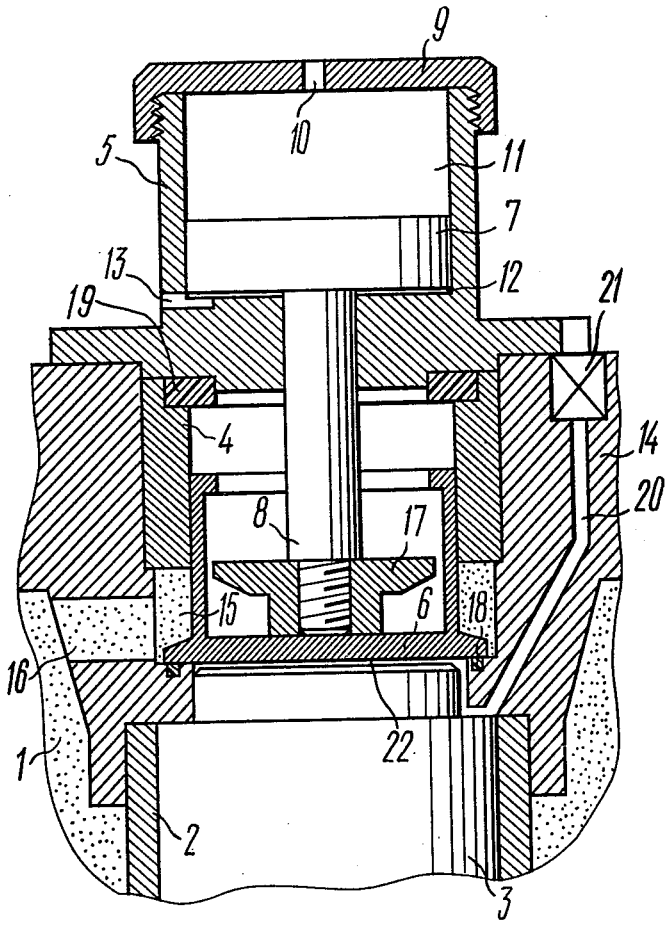
9
10
5
11
7
13
12
19
21
4
14
20
8
17
15
6
18
16
22
1
2
3

STRIKER STARTING MECHANISM OF HYDRODYNAMIC UNIT

FIELD OF THE INVENTION

The present invention relates to devices for hydrodynamic stamping and, more particularly, it relates to striker starting mechanisms of hydrodynamic units.

The present invention can be used most advantageously for developing striker starting means in hydrodynamic presses providing for full opening of the valve prior to starting the striker acceleration.

This invention can be also used for developing pneumatic percussion devices.

DESCRIPTION OF THE PRIOR ART

There are known in the art devices for hydrodynamic stamping equipped with striker starting mechanism of different designs, said mechanisms injecting compressed gas to the above-striker space of the cylinder for the striker to accelerate and accumulate kinetic energy which turns to pulsed pressure upon striker impact against liquid.

Prior art devices face a problem of rapid opening of passages communicating the compressed gas receiver with the above-striker space of the cylinder, such that the striker should be accelerated by a gas pressure close to that in the receiver with a view to reducing the losses in the energy of compressed gas when throttling the latter through an opening port of the starting device.

There are also known in the art devices for hydrodynamic stamping wherein the starting mechanism (means for feeding compressed gas into the above-striker space of the shaft) is fashioned in the form of a system of slide valves, with a main valve which includes a gate and a spring affecting the latter being arranged on a conduit which communicates the receiver with the above-striker space of the cylinder. An additional distributor of the compressed gas supply, comprising a spring, is mounted at the side of the main valve and has a small-diameter piston, a slider and a large-diameter piston made integral with an axial control rod extending inside the cylinder. The additional distributor communicates via channels with the above-striker space of the cylinder and with the channel for the supply of air to said space. The additional distributor also has an outlet port and a series of conduits and openings (cf., French Patent No. 2,138,378).

Further known in the art is a striker starting mechanism in a device for treating materials, comprising three axially aligned cylinders with pistons located therein for reciprocation. The two main cylinders, namely, a large-diameter top cylinder and a small-diameter bottom cylinder, are interconnected with the aid of flanges. A series of circumferentially arranged ports are provided in the body of the bottom cylinder. The working piston housed therein provides a means for opening the ports to let compressed gas from the receiver to the above-striker space of the shaft and for subsequently closing said ports. The other piston located in the large-diameter top cylinder serves as a means for controlling the first, working cylinder and makes the latter move in response to an appropriate external signal. At the same time, the top cylinder serves as a receiver of compressed gas used for accelerating the striker. Both pistons are rigidly interconnected by means of a rod and form a slide. The return of the slide to the initial position is effected by means of an additional, third cylinder formed by a central bore in the rod. A support rod on which the slide moves is immovably mounted on the lower flange of the working cylinder. The supply of gas for returning the slide to the initial position is effected via passage provided in the body of the support rod.

In the initial position, both pistons are urged against the respective end seals by the resultant force of gas pressure against the various areas of the piston surface. A rigid connection of the working and control pistons serves to increase the inertial mass of the slide and, therefore, in the design provision is made for a certain distance between the initial position of the working piston and the upper edge of the outlet ports, through which distance the slide is accelerated at a rate sufficient to ensure the shortest time of transition from fully closed ports to fully opened ones and an abrupt ejection of compressed gas to the above-striker space of the shaft. However, the provision of such distance, combined with the working piston stroke along the outlet ports, results in the formation of a "parasite" volume in which the compressed gas from the receiver expands and releases energy without performing any useful work. Since the bottom cylinder is arranged structurally inside the shaft in the top portion thereof, the "parasite" volume may reach considerable size.

Said prior art striker starting mechanism operates in the following manner.

Compressed gas filling the space of the control cylinder acts upon the inner end surfaces of the control and working pistons and, owing to the difference in their areas, urges the slide against elastic seals while maintaining it in unstable equilibrium. When the cylinder space comes in communication with the gap provided between the control cylinder lid and control piston, the equilibrium is disturbed, the pressure acting upon the inner end face of the control piston is canceled by the pressure acting upon the outer end of said piston, and the pressure acting upon the inner end of the working piston starts moving the slide and withdrawing it from the seal. After the slide is displaced and withdrawn from the seals, the gas from the receiver rushes through a plurality of openings provided over the periphery of the control piston and fully balances the pressure on the opposite surfaces of the control piston. As a result, the slide moves at a very high acceleration rate under the effect of the force developed by the pressure of gas against the working piston and acquires a high velocity by the time it reaches the ports. The release of gas to the above-striker space of the working cylinder occurs over a very short period of time.

At the end of the stroke the slide is braked and displaces the liquid from the lower portion of the seat of the working piston cylinder. The slide is returned to the initial position by the gas supplied from the source along the support passage.

The afore-described prior art mechanism suffers from a series of disadvantages, primarily:

the complexity of design due to the presence of three piston-cylinder pairs for opening the outlet ports and returning the slide to the initial position, and the need for a strictly coaxial arrangement of said pairs rendering the structure rather inefficient and placing most stringent requirements upon the accuracy of manufacture of both single elements and the structure in general;

high accelerations upon starting and, in particular, upon stopping the slide cause enormous stresses therein, which requires the use of highly strong and lightweight materials for its manufacture, however, the service life of the striker is rather insufficient even if said conditions are met; and a low efficiency figure due to the presence of a structurally essential large "parasite" volume between the working piston of the mechanism and the striker, as well as due to losses caused by the fact that the gas passed through the plurality of openings in the control piston will not take part in accelerating the striker.

SUMMARY OF THE INVENTION

It is the principal object of the present invention to develop a striker starting mechanism for a hydrodynamic unit, which would help considerably simplify the design of the unit.

It is another object of this invention to develop such mechanism that would help considerably improve the efficiency of the hydrodynamic unit.

These and other objects of the present invention are attained through the use of a mechanism for starting a striker for accelerating the striker in the shaft of a hydrodynamic unit, having a compressed gas receiver and two cylinders arranged in series one after the other, namely, a control cylinder and a working cylinder, whose pistons are interconnected by means of a rod. The piston of the control cylinder is acted upon by a compressed medium which sets said piston in motion and acts via the rod to move the piston of the working cylinder. According to the invention, the working cylinder is mounted in the receiver to define a circular space between the end of said cylinder and the end of the shaft, said space communicating with the space of the receiver while the piston of said working cylinder is mounted for movement relative to the rod.

Such an arrangement makes for a possibility of increasing the efficiency of the unit due to an increased speed of response of the unit by reducing the inertial mass of the working cylinder piston. Upon separation of the working piston from the end seal located on the end of the shaft, compressed gas supplied to the space between the working cylinder piston and the striker accelerates only the working cylinder piston for full opening of the inlet port due to the absence of rigid coupling between the rod and piston of the working cylinder. In addition, the circular space reduces the path of compressed gas from the receiver to the outlet port of the shaft and, consequently, energy losses along said path.

The absence of rigid coupling between the rod and piston of the working cylinder makes for a simpler structure and for lower requirements placed upon the accuracy of manufacture of both individual parts and the entire mechanism inasmuch as no axial alignment of the control and working cylinders is required in this case.

The herein disclosed mechanism design helps practically eliminate the "parasite" volume, whereby the efficiency of compressed gas energy is sharply increased. A decrease of the mass of the working piston as compared with that of the prototype slide and the reduction of the acceleration path help considerably reduce the loads in the piston of the working cylinder, thereby lowering the requirements upon the piston material and extending the service life of the overall mechanism.

It is expedient that the piston of the working cylinder be made hollow and accommodate thereinside a stop secured on the rod and acting upon said piston in order to communicate the receiver space with the shaft space upon starting the striker and to close said spaces upon return of the striker to the initial position.

Such an arrangement helps further to improve the speed of response due to reducing the mass of the working cylinder piston and to simplify the overall mechanism.

It is also expedient to communicate the space between the striker and bottom piston with the atmosphere by means of a passage provided in the receiver body.

The provision of said passage prevents spontaneous operation of the starting mechanism due to possible leakage of compressed gas through the end seal.

BRIEF DESCRIPTION OF THE INVENTION

The present invention will be more apparent upon considering the following detailed description of an examplary embodiment thereof with due reference to the accompanying drawing which shows a partial, longitudinal, sectional view of the mechanism for starting a striker for accelerating the striker in the shaft of a hydrodynamic unit.

DETAILED DESCRIPTION OF THE INVENTION

Disclosure is made of a mechanism for starting a striker for accelerating the striker in the shaft of a hydrodynamic unit, which comprises a compressed gas receiver 1 enveloping a shaft 2 of the hydrodynamic unit with a striker 3 movable therein. The starting mechanism further comprises a working cylinder 4 and a control cylinder 5, the cylinders being arranged in series one after the other and having a working piston 6 and a control piston 7, respectively. The pistons 6 and 7 are interconnected by means of a rod 8. The control cylinder 5 is covered with a lid 9 having a channel 10 for the supply of compressed medium to a piston space 11. Compressed medium is supplied to a rod space 12 of the control cylinder 5 via channel 13. The cylinders 4 and 5 are mounted in a lid 14 closing the spaces of the receiver 1 and shaft 2, the working cylinder 4 being mounted to define a circular space 15 between the receiver end and the end of the shaft 2, said space communicating with the space of the receiver 1 via passages 16. The piston 6 of the working cylinder 4 is mounted for movement relative to the rod 8 on whose end there is provided a stop 17 acting upon the piston 6 during the mechanism operation. In the initial position, the piston 6 is urged against a seal 18. In order to reduce the stresses occurring in the piston 6 upon braking, an absorber 19 is provided. For precluding spontaneous starting of the striker due to the leakage of compressed gas via the seal 18, a passage 20 is provided in the lid 14 of the receiver 1, said passage housing a conventional controlled valve 21 which is opened when the working piston 6 closes inlet port 22 of the shaft 2 and closed prior to opening of said port.

The herein disclosed striker starting mechanism of a hydrodynamic unit operates in the following manner.

Shown in the drawing is the moment when the working piston 6 is urged against the seal 18 by the force of the control cylinder and the pressure of compressed gas in the circular space 15. While so doing, the valve 21 is open and the space between the striker 3 and the working piston 6 communicates with the atmosphere by means of the passage 20.

For starting the striker, i.e., for communicating the receiver 1 with the above-striker space of the shaft 2, compressed medium is supplied to the rod space 12 of the control cylinder 5 via the channel 13, and the piston 7 together with the rod 8 and the stop 17 start moving upwards. Upon said movement, the valve 21 closes. The stop 17 moving upwards reaches the flange of the working piston 6 and separates the working piston 6 from the seal 18, whereupon the compressed gas moves into the space between the working piston 6 and striker 3 to affect the ends of the latter and accelerate them in the opposite directions.

Since the mass of the piston 6 is 10–20 times less than that of the striker 3, the striker 3 will move 1–2 mm from its initial position by the time the working piston 6 reaches the absorber 19 and opens the inlet port 22 of the shaft 2 fully, and the entire stage of acceleration of the striker 3 by compressed gas will take place with the passages 16 and port 22 fully opened, thereby eliminating the losses of compressed gas energy for throttling.

After a preset volume of compressed gas has been passed over to the above-striker space of the shaft 2, the compressed medium is supplied via channel 10 to the piston space 11 of the control cylinder 5. The piston 7 with the rod 8 and stop 17 move downwards to urge the working piston 6 against the seal 18 and disconnect the receiver 1 from the above-striker space of the shaft 2, the valve 21 being opened to reduce the pressure in the space between the striker 3 and the working piston 6 down to atmospheric pressure.

Due to such an arrangement, the starting mechanism according to the invention is simple in design and requires no special materials and complicated techniques for its manufacture, whereby its cost is reduced considerably. The absence of "parasite" volumes and the high speed of response make for a much higher efficiency of the hydrodynamic unit.

What is claimed is:

1. A striker starting mechanism of a hydrodynamic unit, comprising: a shaft in which said striker is movable; a compressed gas receiver enveloping said shaft; a lid closing spaces of said receiver and said shaft; a control cylinder and a working cylinder arranged in series one after the other, each cylinder having a piston, said working cylinder being mounted in said lid, and a circular space defined by the end of said working cylinder and the end of said shaft and communicating with the space of said receiver; a rod interconnecting the pistons of said cylinders, the piston of said working cylinder being mounted for movement relative to said rod; a compressed medium acting upon the piston of said control cylinder to set said piston in motion and, via said rod, acting upon the piston of said working cylinder.

2. A striker starting mechanism as set forth in claim 1, wherein the piston of said working cylinder is hollow and accommodates thereinside a stop secured on said rod and acting upon said working piston in order to communicate the space of said receiver with the space of said shaft upon starting the striker and to close said spaces upon the return of said striker to an initial position.

3. A striker starting mechanism as set forth in claim 1, wherein the space between the striker and the piston of said working cylinder communicates with the atmosphere by means of a passage provided in the lid of said receiver.

* * * * *